US010935031B2

(12) United States Patent
Takaki et al.

(10) Patent No.: US 10,935,031 B2
(45) Date of Patent: Mar. 2, 2021

(54) BOOSTER SYSTEM

(71) Applicant: MITSUBISHI HEAVY INDUSTRIES COMPRESSOR CORPORATION, Tokyo (JP)

(72) Inventors: Hiroyuki Takaki, Tokyo (JP); Yosuke Nakagawa, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 294 days.

(21) Appl. No.: 16/075,531

(22) PCT Filed: Feb. 6, 2017

(86) PCT No.: PCT/JP2017/004204
§ 371 (c)(1),
(2) Date: Aug. 3, 2018

(87) PCT Pub. No.: WO2017/138486
PCT Pub. Date: Aug. 17, 2017

(65) Prior Publication Data

US 2019/0040864 A1 Feb. 7, 2019

(30) Foreign Application Priority Data

Feb. 8, 2016 (JP) ..... JP2016-022223

(51) Int. Cl.
*F04D 17/12* (2006.01)
*F25J 1/00* (2006.01)
(Continued)

(52) U.S. Cl.
CPC ..... *F04D 17/12* (2013.01); *F04D 29/5833* (2013.01); *F25J 1/0027* (2013.01);
(Continued)

(58) Field of Classification Search
CPC ..... F25J 1/0045; F25J 1/0202; F25J 1/0027; F25J 1/0298; F04D 17/12
See application file for complete search history.

(56) References Cited

U.S. PATENT DOCUMENTS

2014/0061941 A1* 3/2014 Gotou ..... H01L 23/53295 257/774
2014/0069141 A1 3/2014 Yonemura et al.
2016/0123351 A1 5/2016 Nagao et al.

FOREIGN PATENT DOCUMENTS

JP 2010266154 A * 11/2010
JP 5826265 B2 12/2015
WO 2015/107615 A1 7/2015

OTHER PUBLICATIONS

JP-2010266154-A Translation (Year: 2010).*
(Continued)

*Primary Examiner* — Brian M King
(74) *Attorney, Agent, or Firm* — Osha Bergman Watanabe & Burton LLP

(57) ABSTRACT

A booster system includes: a cooling temperature regulating unit configured to regulate a temperature of an intermediate supercritical pressure liquid cooled and generated by a main cooling unit on upstream of a pump unit according to a flow rate of a supplied cooling medium; and a pressure detection unit configured to detect inlet pressure of the intermediate supercritical pressure liquid on an inlet side of the pump unit and detect outlet pressure of a target supercritical fluid on an outlet side of the pump unit. The cooling temperature regulating unit controls the flow rate of the cooling medium based on a pressure difference between the inlet pressure and the outlet pressure or a pressure ratio between the inlet pressure and the outlet pressure.

18 Claims, 8 Drawing Sheets

(51) Int. Cl.

| | |
|---|---|
| ***F25J 1/02*** | (2006.01) |
| ***F04D 29/58*** | (2006.01) |
| *F04D 27/02* | (2006.01) |

(52) U.S. Cl.

CPC ..... *F25J 1/0045* (2013.01); *F25J 1/0202* (2013.01); *F25J 1/0279* (2013.01); *F25J 1/0298* (2013.01); *F04D 27/0215* (2013.01); *F04D 29/5813* (2013.01); *F25J 2230/20* (2013.01)

(56) References Cited

OTHER PUBLICATIONS

International Search Report issued in corresponding International Application No. PCT/JP2017/004204 dated Mar. 21, 2017, with translation (5 pages).

Written Opinion of the International Searching Authority issued in corresponding International Application No. PCT/JP2017/004204 dated Mar. 21, 2017 (3 pages).

* cited by examiner

BOOSTER SYSTEM

TECHNICAL FIELD

The present invention relates to a booster system for increasing pressure of a gas.

BACKGROUND ART

A booster system is a device for increasing pressure of an object gas to target pressure, and a technology is considered of using the booster system to liquefy carbon dioxide by increasing pressure and store the carbon dioxide under the ground or under the seafloor, thereby reducing carbon dioxide in atmosphere. In recent years, problems such as global warming have become apparent due to an increase in emission of carbon dioxide known as greenhouse gases, and separating and recovering carbon dioxide contained in emission gases, for example, from a thermal power plant and then increasing pressure of the carbon dioxide using a booster system has been considered.

In this booster system, a compressor configured in a multistage structure is used to gradually compress carbon dioxide, and the carbon dioxide in a state at supercritical pressure and temperature or higher is cooled to obtain carbon dioxide at target temperature and pressure optimum for transportation and storage. As such a booster system, systems disclosed in Patent Literatures 1 and 2 are known.

The booster systems disclosed in Patent Literatures 1 and 2 each mainly include a compression unit, a cooling unit, and a pump unit. The compression unit compresses an object gas to intermediate pressure equal to and higher than critical pressure and lower than target pressure to generate an intermediate supercritical fluid. The cooling unit cools the intermediate supercritical fluid generated by the compression unit to around a critical temperature to generate an intermediate supercritical pressure liquid. The pump unit increases pressure of the intermediate supercritical pressure liquid generated by the cooling unit to target pressure or higher. The cooling unit extracts a part of the intermediate supercritical fluid generated by the compression unit and uses the part of the intermediate supercritical fluid as a cooling medium.

In Patent Literature 2, a cooling temperature regulating unit is provided on upstream of the pump unit to regulate a temperature of an intermediate supercritical pressure liquid generated by the cooling unit. As such, in Patent Literature 2, the temperature of the intermediate supercritical pressure liquid generated by the cooling unit can be regulated to regulate pressure of a target supercritical fluid finally generated even at a constant pump rotation speed of the pump unit. More specifically, in Patent Literature 2, a pressure detection unit that detects pressure of carbon dioxide heated by a heating unit provided on a downstream side of the pump unit, and a flow regulating valve that regulates an amount of a cooling medium (intermediate supercritical fluid) supplied into the cooling unit are provided, and an opening degree of the flow regulating valve is regulated based on a deviation between a detection value detected by the pressure detection unit and a predetermined pressure range. As such, in Patent Literature 2, the temperature of the intermediate supercritical pressure liquid generated by the cooling unit and sucked into the pump unit (pump inlet temperature) is regulated. In Patent Literature 2, the pressure of the carbon dioxide heated by the heating unit is the final discharge pressure of the booster system.

CITATION LIST

Patent Literature

Patent Literature 1: JP 5826265 B2

Patent Literature 2: International Publication No. 2015/107615

SUMMARY OF INVENTION

Technical Problem

In the above booster systems, an operation with a partial load is sometimes performed in which a flow rate of carbon dioxide is lower than that at a rated operation point. Also in this partial load operation, final discharge pressure of the booster system needs to be constantly maintained.

However, if the amount of the cooling medium supplied into the cooling unit is regulated according to the control method disclosed in Patent Literature 2, the amount of the intermediate supercritical fluid flowing toward the pump unit is changed to change a temperature (pump inlet temperature) of carbon dioxide on an inlet side of the pump unit and also change pressure (pump inlet pressure) of the carbon dioxide on the inlet side of the pump unit. Since a density is changed by an influence of both the temperature and the pressure, a control operation due to a pressure change may be added to cause the flow regulating valve to perform an operation different from an intended control operation. For example, when pressure (pump outlet pressure) on an outlet side of the pump unit, that is, final discharge pressure is higher than a predetermined pressure range, an opening degree of the flow regulating valve is reduced to reduce the flow rate of the cooling medium supplied into the cooling unit and increase the pump inlet temperature. Then, in control of the flow regulating valve based on the pump outlet pressure, the amount of the intermediate supercritical fluid flowing toward the pump unit is increased to increase the pump inlet pressure, which interferes with a demand to reduce the pump outlet pressure and may prevent originally intended density regulation of carbon dioxide according to a change in the pump inlet temperature.

Also, for example, an operation of the compression unit may be controlled to constantly control the pump inlet pressure. However, this control interferes with the control of the pump outlet pressure (final discharge pressure), thereby preventing a stable operation.

Thus, the present invention has an object to provide a booster system capable of stably controlling final discharge pressure even if a load varies during an operation as in a partial load operation.

Solution to Problem

The present invention provides a booster system for increasing pressure of an object gas to pressure equal to or higher than target pressure that is higher than critical pressure, including: a first compression unit configured to compress the object gas to intermediate pressure equal to or higher than the critical pressure and lower than the target pressure to generate an intermediate supercritical fluid; a cooling unit configured to cool the intermediate supercritical fluid generated by the first compression unit to around a critical temperature to generate an intermediate supercritical pressure liquid (i.e., a liquid at supercritical pressure); a second compression unit configured to increase pressure of the intermediate supercritical pressure liquid generated by the cooling unit to pressure equal to or higher than the target pressure; a cooling temperature regulating unit configured to regulate a temperature of the intermediate supercritical pressure liquid generated by the cooling unit on upstream of the second compression unit according to a flow rate of a supplied cooling medium; and a pressure detection unit configured to detect inlet pressure P1 of the intermediate supercritical pressure liquid on an inlet side of the second compression unit and detect outlet pressure P2 of a target supercritical fluid on an outlet side of the second compression unit.

The cooling temperature regulating unit according to a first aspect of the present invention controls the flow rate of the cooling medium so that a pressure difference between the inlet pressure P1 and the outlet pressure P2 or a pressure ratio between the inlet pressure P1 and the outlet pressure P2 is within a predetermined range.

Next, the cooling temperature regulating unit according to a second aspect of the present invention increases or decreases the flow rate of the cooling medium based on a deviation ΔP between the outlet pressure P2 and a preset determination value Ps when the outlet pressure P2 of the target supercritical fluid detected by the pressure detection unit exceeds a range of a dead band with reference to the determination value Ps. The cooling temperature regulating unit maintains a previous flow rate of the cooling medium when the outlet pressure P2 falls within the range of the dead band.

In the present invention, the second compression unit preferably includes one or more pumps.

According to the booster system, compression on a front stage side is performed by the compression unit, and pressure on a rear stage side at higher pressure is increased by the pump pumping the intermediate supercritical fluid to obtain a liquid at pressure equal to or higher than the target pressure. A compressor may be applied to the second compression unit at higher pressure, but many high pressure gas seals and many compressor casings corresponding to high pressure are required. Adopting the pump on the rear stage side eliminates the need for the components corresponding to high pressure, thereby reducing costs and improving reliability.

In the present invention, the booster system may further include a heating unit configured to heat the intermediate supercritical pressure liquid increased in pressure by the second compression unit to around a critical temperature to generate a target supercritical fluid. In this case, the cooling unit may include a main cooling unit configured to perform heat exchange with the heating unit to cool the intermediate supercritical fluid.

According to the booster system, the liquid at pressure equal to or higher than the target pressure generated by the second compression unit may be heated to around the critical temperature by the heating unit to obtain a supercritical fluid at target pressure and temperature.

The main cooling unit in the cooling unit may use heat recovered in cooling of the intermediate supercritical fluid to more efficiently heat the intermediate supercritical pressure liquid to around the critical temperature to obtain a supercritical fluid (target supercritical fluid) at target pressure and temperature.

In the present invention, the cooling temperature regulating unit can extract a part of the intermediate supercritical fluid generated by the first compression unit and use the part of the intermediate supercritical fluid as the cooling medium.

Then, cold energy of the intermediate supercritical pressure liquid itself introduced into the second compression unit can be effectively used, thereby ensuring that the intermediate supercritical pressure liquid introduced into the second compression unit can be generated without separately providing a condenser required for generating the intermediate supercritical pressure liquid from the intermediate supercritical fluid.

In the present invention, the cooling temperature regulating unit can regulate the flow rate of the cooling medium supplied into the cooling unit.

As such, regulating the flow rate of the cooling medium can regulate the temperature and the pressure of the intermediate supercritical fluid generated by the cooling unit to desired values.

In the present invention, the cooling temperature regulating unit includes a flow regulating unit configured to regulate the flow rate of the cooling medium supplied into the cooling unit, and a control unit configured to control the flow regulating unit based on a detection value detected by the pressure detection unit. The control unit may include a determination unit configured to determine whether or not the detection value falls within a predetermined pressure range, and a flow rate decision unit configured to decide the flow rate to be regulated by the flow regulating unit based on a determination result of the determination unit.

Such a configuration allows the pressure of the target supercritical pressure fluid to be more stably maintained.

Advantageous Effects of Invention

With the booster system according to the first aspect of the present invention, regulation of an opening degree of the flow regulating unit is controlled so that the pressure difference between the inlet pressure and the outlet pressure of the second compression unit is constant. Specifically, the booster system of the present invention regulates the opening degree of the flow regulating unit based on the pressure difference in view of both the inlet pressure and the outlet pressure, thereby preventing interference between controls that may occur when the flow regulating unit is regulated only based on the outlet pressure. Thus, even if a valve mechanism of an inlet of the first compression unit or a rotation speed of the first compression unit is regulated to constantly control the inlet pressure of the second compression unit, this control and the control according to the pressure difference have different responses, thereby preventing interference between the controls. Constantly controlling the inlet pressure can also constantly control final discharge pressure.

With the booster system according to the second aspect of the present invention, discharge pressure control includes the dead band, and the flow regulating unit is regulated only when the outlet pressure significantly changes. Thus, when the outlet pressure changes little, a previous flow rate is maintained without changing the opening degree of the flow regulating unit. When the outlet pressure is significantly deviated from the determination value, the opening degree of the flow regulating unit is regulated. This reduces time when the control of the outlet pressure and the control of suction pressure of the second compression unit, typically, the pump are simultaneously performed, thereby preventing the interference between the controls.

DESCRIPTION OF EMBODIMENTS

First Embodiment

Now, with reference to the accompanying drawings, a first embodiment of a booster system according to the present invention will be described.

A booster system 1A according to this embodiment is a system for increasing pressure of carbon dioxide F in a gas state as an object gas to pressure equal to or higher than target pressure that is higher than critical pressure.

Figure 1:
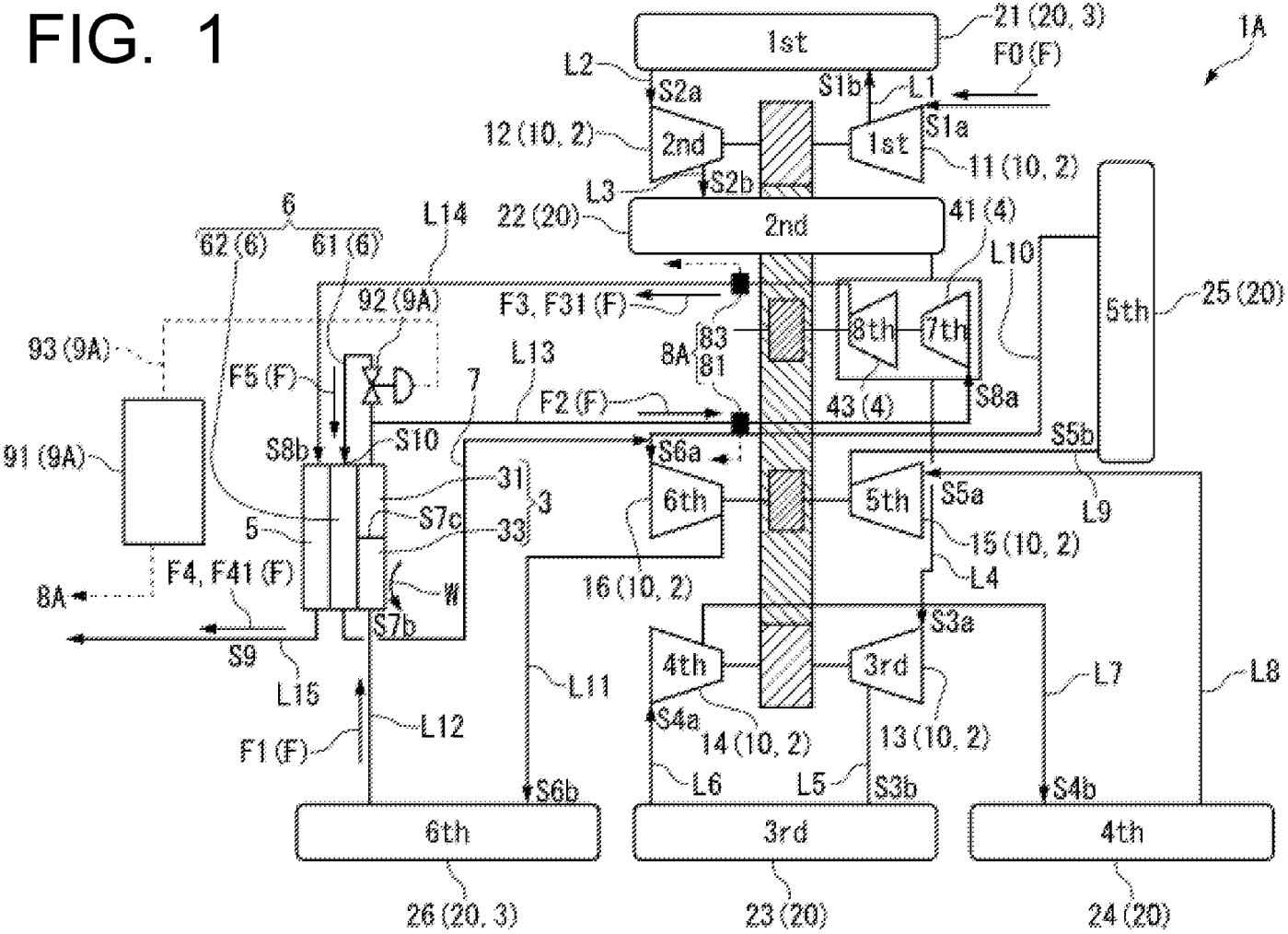
FIG. 1 is schematic system diagram of a booster system according to a first embodiment of the present invention.

As shown in FIG. 1, the booster system 1A includes a compression unit 2 that takes in and compresses carbon dioxide F, a cooling unit 3 that cools an intermediate supercritical fluid generated by the compression unit 2 to around a critical temperature to generate an intermediate supercritical pressure liquid, and a pump unit 4 that increases pressure of the intermediate supercritical pressure liquid generated by the cooling unit to pressure equal to or higher than target pressure.

The booster system 1A also includes a heating unit 5 that heats carbon dioxide F increased in pressure by the pump unit 4, a liquid extracting and pressure reducing unit 6 that is provided between the cooling unit 3 and the pump unit 4 to extract the carbon dioxide F, and a bypass flow path 7 through which the carbon dioxide F from the liquid extracting and pressure reducing unit 6 is returned to the compression unit 2.

In addition, the booster system 1A includes a pressure detection unit 8A that detects pressure (inlet pressure) P1 of the carbon dioxide F on an inlet side of the pump unit 4 and pressure (outlet pressure) P2 of the carbon dioxide F on an outlet side, and a cooling temperature regulating unit 9A that regulates a flow rate of the carbon dioxide F extracted by the liquid extracting and pressure reducing unit 6 based on a pressure value of the carbon dioxide F detected by the pressure detection unit 8A.

The booster system 1A of this embodiment is characterized in that the cooling temperature regulating unit 9A regulates the flow rate of the carbon dioxide F based on the inlet pressure P1 and the outlet pressure P2 detected by the pressure detection unit 8A.

Now, each component of the booster system 1A will be described, and then operations of the booster system 1A and operations and effects of the booster system 1A will be described in this order.

[Compression Unit 2]

The compression unit 2 constitutes a first compression unit in the present invention and includes a geared compressor of a multiaxis and multistage configuration in which a plurality of impellers are interlocked via gears.

The compression unit 2 includes a plurality of impellers 10 provided in multiple stages (six stages in this embodiment), and a plurality of intermediate coolers 20 each provided between two consecutive impellers 10 and between an impeller 10 and the cooling unit 3. The compression unit 2 uses the taken carbon dioxide F as an introduced gas F0 and repeats compression and cooling to compress the carbon dioxide F to a pressure state at intermediate pressure equal to or higher than critical pressure and lower than target pressure to generate an intermediate supercritical fluid F1.

The critical pressure of the carbon dioxide F is 7.4 [MPa], and as the target pressure, for example, 15 [MPa] is set which is a value higher than the critical pressure. As the intermediate pressure of the intermediate supercritical fluid F1 generated by the compression unit 2, for example, 10 [MPa] is set. However, the values of the target pressure and the intermediate pressure are decided as appropriate according to the critical pressure of the object gas, and do not limit the present invention.

The compression unit 2 includes a first stage compression impeller 11, a first intermediate cooler 21, a second stage compression impeller 12, a second intermediate cooler 22, a third stage compression impeller 13, a third intermediate cooler 23, a fourth stage compression impeller 14, a fourth intermediate cooler 24, a fifth stage compression impeller 15, a fifth intermediate cooler 25, a sixth stage compression impeller 16, and a sixth intermediate cooler 26 provided in this order from an upstream side toward a downstream side of the flow of the taken carbon dioxide F. These components of the compression unit 2 are connected by pipe lines L1, L2, L3, L4, L5, L6, L7, L8, L9, L10, and L11 between the components.

[Cooling Unit 3]

The cooling unit 3 is connected to a downstream side of the sixth intermediate cooler 26 by the pipe line L12, cools the intermediate supercritical fluid F1 generated by the sixth stage compression impeller 16 as a final stage of the compression unit 2 to around a critical temperature and liquefies the intermediate supercritical fluid F1 to generate an intermediate supercritical pressure liquid F2.

The cooling unit 3 includes a precooling unit 33 that precools the intermediate supercritical fluid F1 generated by the compression unit 2, and a main cooling unit 31 that further cools the intermediate supercritical fluid F1 cooled by the precooling unit 33 to generate the intermediate supercritical pressure liquid F2.

The precooling unit 33 is a heat exchanger that precools the intermediate supercritical fluid F1 using an external cooling medium W supplied from a pipe line (not shown).

The main cooling unit 31 introduces a low temperature liquid F5 from the liquid extracting and pressure reducing unit 6 described later and uses the low temperature liquid F5 as a cooling medium to cool the intermediate supercritical fluid F1. In this embodiment, heat obtained by the main cooling unit 31 cooling the intermediate supercritical fluid F1 is used for heating by the heating unit 5, and the main cooling unit 31 and the heating unit 5 constitute one heat exchanger.

In this embodiment, the main cooling unit 31 uses the low temperature liquid F5 from the liquid extracting and pressure reducing unit 6 as the cooling medium. However, if an appropriate cooling medium W can be obtained from outside, precooling by the precooling unit 33 can reduce cold energy required by the main cooling unit 31. A cooling capacity of the precooling unit 33 differs depending on a temperature, a flow rate, or the like of the external cooling medium W taken from outside by the precooling unit 33.

If the intermediate supercritical fluid F1 generated by the compression unit 2 can be cooled to a transition region to a liquid only using a sixth intermediate cooler 26 and then liquefied by the main cooling unit 31 to generate the intermediate supercritical pressure liquid F2, the precooling unit 33 may be omitted.

Additionally, when the cooling unit 3 cools the intermediate supercritical fluid F1 to around the critical temperature, cooling to a temperature of ±20[° C.] of the critical temperature is preferable, cooling to a temperature of ±15[° C.] of the critical temperature is more preferable, and cooling to a temperature of ±10[° C.] of the critical temperature is most preferable.

[Pump Unit 4]

The pump unit 4 constitutes a second compression unit in the present invention. The pump unit 4 is connected to a downstream side of the cooling unit 3 by a pipe line L13, introduces the intermediate supercritical pressure liquid F2 generated by passing through the cooling unit 3 and increases pressure of the intermediate supercritical pressure liquid F2 to a pressure state at target pressure to generate a target pressure liquid F3. In this embodiment, the pump unit 4 adopts a two-stage configuration including a first stage pump impeller 41 and a second stage pump impeller 43. However, the pump unit 4 may adopt any configuration as long as it can increase pressure of the intermediate supercritical pressure liquid F2 to the target pressure.

As described above, a first pressure sensor 81 is provided in the pipe line L13.

[Heating Unit 5]

The heating unit 5 is connected to a downstream side of the pump unit 4 by a pipe line L14 and introduces the target pressure liquid F3 from the pump unit 4 to generate a target supercritical fluid F4 at a critical temperature (31.1° C.) or higher.

As described above, the heating unit 5 constitutes the heat exchanger together with the main cooling unit 31 of the cooling unit 3. Thus, the heating unit 5 performs heat exchange with the main cooling unit 31 to heat the target pressure liquid F3 using condensation heat obtained by the main cooling unit 31 cooling the intermediate supercritical fluid F1.

A second pressure sensor 83 is provided in the pipe line L14.

Further, a pipe line L15 is connected to a downstream side of the heating unit 5. The target supercritical fluid F4 generated by the heating unit 5 flows into the pipe line L15 and is then supplied to external equipment connected to the downstream side.

[Liquid Extracting and Pressure Reducing Unit 6]

The liquid extracting and pressure reducing unit 6 is provided between the main cooling unit 31 and the pump unit 4 and uses the low temperature liquid F5 obtained by extracting a part of the intermediate supercritical pressure liquid F2 from the main cooling unit 31 to cool the intermediate supercritical fluid F1 in the main cooling unit 31. This cooling heats the low temperature liquid F5 itself.

Specifically, the liquid extracting and pressure reducing unit 6 includes a branch pipe line 61 having one end connected to the pipe line L13 so as to branch off from the pipe line L13 between the main cooling unit 31 and the pump unit 4, and a heat exchanger 62 to which the other end of the branch pipe line 61 is connected and that performs heat exchange with the main cooling unit 31. Further, a flow regulating unit 92 is provided in a middle position of the branch pipe line 61. The flow regulating unit 92 includes a valve with a regulatable opening degree, and for example, a flow regulating valve is adopted.

[Bypass Flow Path 7]

The bypass flow path 7 returns the low temperature liquid F5 from the liquid extracting and pressure reducing unit 6 to an upstream side of the sixth stage compression impeller 16 of the compression unit 2. The bypass flow path 7 has one end connected to the heat exchanger 62 of the liquid extracting and pressure reducing unit 6, and the other end connected to the pipe line L10 between the sixth stage compression impeller 16 and the fifth intermediate cooler 25.

[Pressure Detection Unit 8A]

The pressure detection unit 8A includes the first pressure sensor 81 provided in the middle of the pipe line L13 and the second pressure sensor 83 provided in the middle of the pipe line L14. The first pressure sensor 81 measures a pressure value of the intermediate supercritical pressure liquid F2 flowing through the pipe line L13, that is, the inlet pressure P1 of the pump unit 4, and the second pressure sensor 83 measures a pressure value of the target pressure liquid F3 flowing through the pipe line L14, that is, the outlet pressure P2 of the pump unit 4.

The inlet pressure P1 and the outlet pressure P2 measured by the pressure detection unit 8A are transmitted to a control unit 91 of a cooling temperature regulating unit 9A described later.

[Cooling Temperature Regulating Unit 9A]

The cooling temperature regulating unit 9A includes a control unit 91 electrically connected to the pressure detection unit 8A, and the flow regulating unit 92 electrically connected to the control unit 91 by a control signal wire 93.

The flow regulating unit 92 regulates the opening degree to reduce pressure of the extracted intermediate supercritical pressure liquid F2 by the Joule-Thomson effect to generate the low temperature liquid F5. The opening degree of the flow regulating unit 92 is regulated by the control unit 91.

Figure 3:
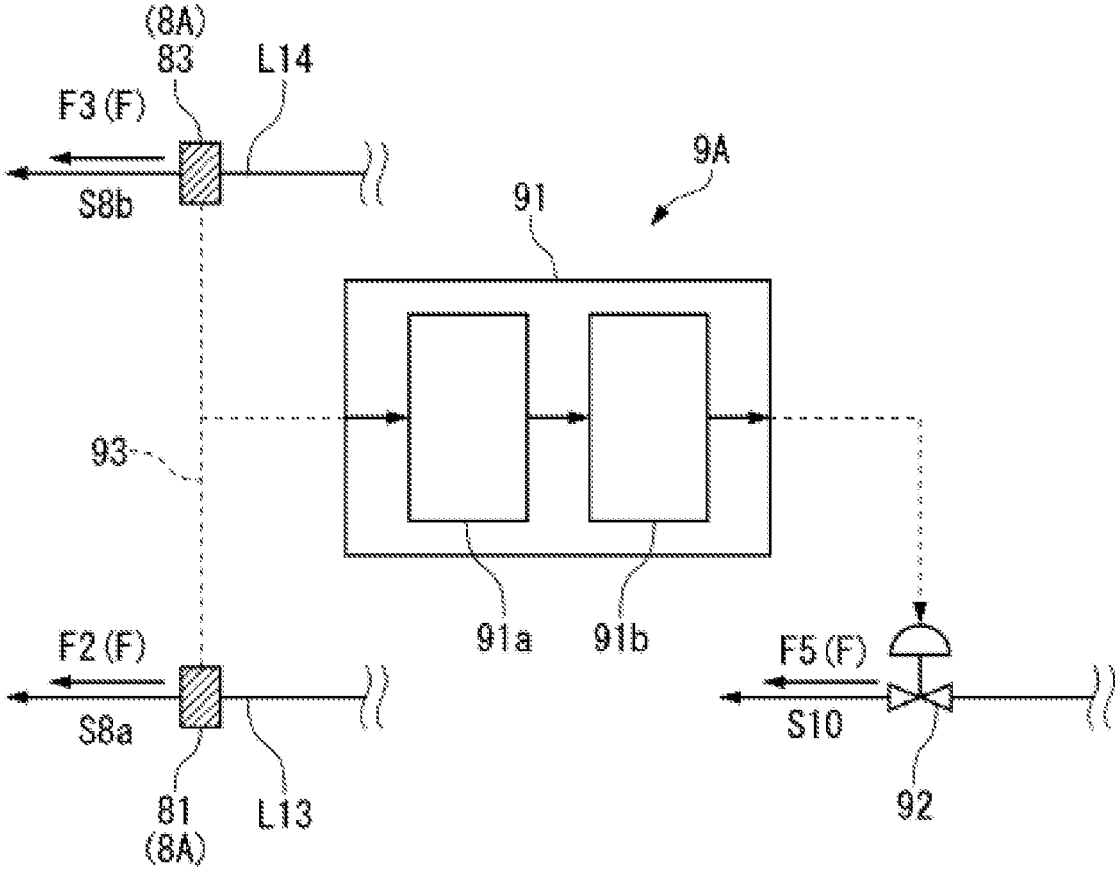
FIG. 3 is an enlarged view of essential portions of a configuration of a temperature cooling unit in connection with the booster system according to the first embodiment.

The control unit 91 includes, for example as shown in FIG. 3, a determination unit 91*a* connected to the pressure detection unit 8A, and a flow rate decision unit 91*b* connected to the determination unit 91*a*.

The determination unit 91*a* is electrically connected to the pressure detection unit 8A, and performs a determination processing whether or not the inlet pressure P1 and the outlet pressure P2 as detection values of the pressure detection unit 8A fall within a preset determination value Ps. The determination value Ps is defined within a numerical range including the target pressure of the target supercritical fluid F4 generated by the booster system 1A, input to the determination unit 91*a* by input means (not shown), and stored and held in the determination unit 91*a*.

The determination unit 91*a* calculates a pressure difference $P_{2-1}$=P2−P1 between the inlet pressure P1 and the outlet pressure P2, compares the pressure difference ΔP with the stored determination value Ps, and calculates a deviation ΔP between the pressure difference P2_1 and the determination value Ps. The deviation ΔP as a determination result of the determination unit 91*a* is transferred to the flow rate decision unit 91*b*. The pressure difference $P_{2-1}$ is P2−P1 herein, but may be P1−P2.

The flow rate decision unit 91*b* performs a predetermined calculation based on the deviation ΔP obtained from the determination unit 91*a* to calculate the opening degree of the flow regulating unit 92. More specifically, first, the deviation ΔP of the pressure value and an amount of increase/decrease in the flow rate required for eliminating the deviation ΔP are derived from a predetermined relational expression. The relational expression is empirically obtained according to performance requirements or the like of the booster system 1A.

The flow rate decision unit 91*b* calculates the opening degree of the flow regulating unit 92 based on the amount of increase/decrease in the flow rate derived by the relational expression. A relationship between the amount of increase/decrease in the flow rate and the opening degree of the flow regulating unit 92 is decided according to performance requirements or the like of the flow regulating valve used for the flow regulating unit 92.

The flow rate decision unit 91*b* transfers instruction information on the decided increase/decrease in the opening degree to the flow regulating unit 92. The flow regulating unit 92 (flow regulating valve) having obtained the instruction information from the flow rate decision unit 91*b* regulates the opening degree according to the instruction information.

As described above, the control unit 91 controls the opening degree of the flow regulating unit 92, that is, the flow rate of the intermediate supercritical pressure liquid F2 so that $P_{2-1}$=P2−P1 matches the determination value Ps.

The control using the pressure difference $P_{2-1}$ has been described herein, but the control may use a pressure ratio $P_{2/1}$.

[State Change of Carbon Dioxide F]

Next, with reference to a P-h diagram in FIG. 2, a state change of the carbon dioxide F (a pressure increasing process of the carbon dioxide F) will be described.

Figure 2:
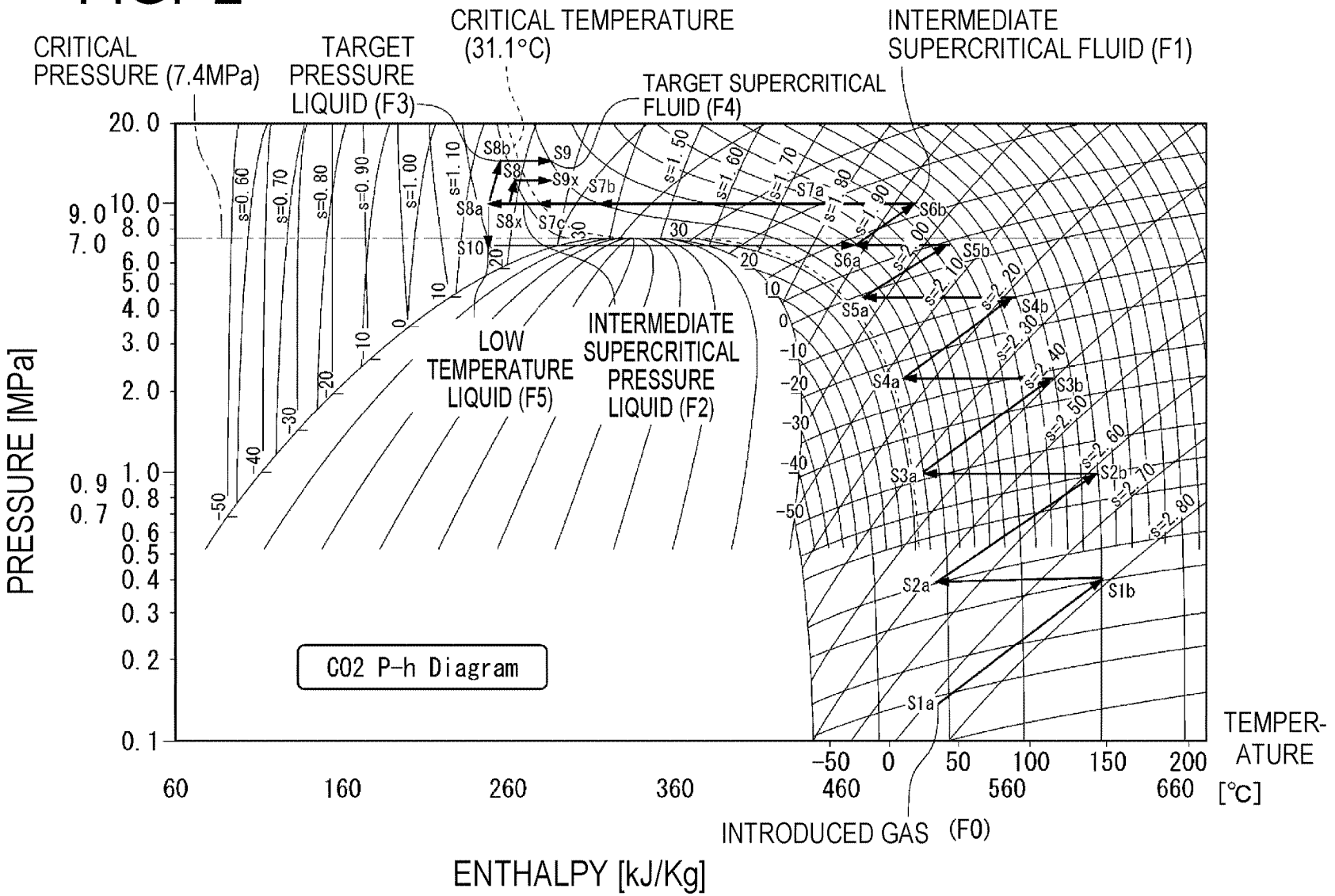
FIG. 2 is a P-h diagram showing a state of carbon dioxide in connection with the booster system according to the first embodiment.

In the compression unit 2, the introduced gas F0 (state S1*a*) introduced into the first stage compression impeller 11 is compressed by the first stage compression impeller 11 as shown by a solid arrow in FIG. 2 and brought into a state S1*b* at higher pressure and higher temperature than the state S1*a*. Then, the first intermediate cooler 21 cools the gas under equal pressure, which is brought into a state S2*a*. Then, compression and cooling are thus repeated to cause state changes: state S2*b*→state S1*a*→state S1*b*→state S4*a*→state S4*b*→state S5*a*→state S5*b*→state S6*a*→state S6*b*→state S7*a*→state S7*b*, and the gas is brought into a state of the intermediate supercritical fluid F1 at pressure equal to or higher than the critical pressure (compression step).

Then, the intermediate supercritical fluid F1 in the state S7*b* is introduced into the precooling unit 33 (state S7*c*). The intermediate supercritical fluid F1 can be further cooled under equal pressure by the precooling unit 33 to reduce the temperature of the intermediate supercritical fluid F1 (cooling step).

The intermediate supercritical fluid F1 is cooled still at the supercritical pressure under equal pressure by the main cooling unit 31, brought into a state S8*a* at a critical temperature or lower, changed in phase into the intermediate supercritical pressure liquid F2, and introduced into the pump unit 4 (cooling step).

In the pump unit 4, the intermediate supercritical pressure liquid F2 in the state S8*a* is increased in pressure to target pressure at which the intermediate supercritical pressure liquid F2 can be stored under the ground or under the seafloor and also increased in temperature to turn into the target pressure liquid F3 in the state S8*b* (pump step). Then, the target pressure liquid F3 is heated by the heating unit 5 to increase the temperature to the critical temperature or higher under equal pressure and brought into a final state S9 in which the carbon dioxide F can be stored under the ground or under the seafloor.

Here, a part of the intermediate supercritical pressure liquid F2 brought into the state S8*a* by the main cooling unit 31 is extracted by regulating the opening degree of the flow regulating unit 92 of the cooling temperature regulating unit 9A. At this time, an amount of the extracted intermediate supercritical pressure liquid F2 is regulated according to the opening degree of the flow regulating unit 92. The extracted intermediate supercritical pressure liquid F2 is reduced in pressure and turns into the low temperature liquid F5 in a state S10. The pressure of the low temperature liquid F5 in the state S10 is pressure corresponding to pressure on the upstream side of the sixth stage compression impeller 16 and on the downstream side of the fifth intermediate cooler 25.

The low temperature liquid F5 is heated by heat exchange with the cooling unit 3 and vaporized still under equal pressure, and turns into a gas or a supercritical fluid in the state S6*a* on the upstream side of the sixth stage compression impeller 16. The gas or the supercritical fluid is returned to the upstream side of the sixth stage compression impeller 16 by the bypass flow path 7 and mixed into the intermediate supercritical fluid F1 flowing through the compression unit 2.

Effects of this Embodiment

Now, effects of the booster system 1A according to the first embodiment will be described. The booster system 1A controls the regulation of the opening degree of the flow regulating unit 92 so that the deviation ΔP (P2−P1) between the inlet pressure P1 and the outlet pressure P2 of the pump unit 4 is constant. Specifically, the booster system 1A regulates the opening degree of the flow regulating unit 92 based on the deviation ΔP in view of both the inlet pressure P1 and the outlet pressure P2, thereby preventing interference between controls that may occur when the flow regulating unit 92 is regulated only based on the outlet pressure P2. Thus, even if a valve mechanism (inlet guide vane (IGV)) of an inlet of the compression unit 2 or a rotation speed of the compression unit 2 is regulated to constantly control the inlet pressure P1, this control and the control according to the deviation ΔP have different responses, thereby preventing interference between the controls. Constantly controlling the inlet pressure P1 can also constantly control final discharge pressure according to this embodiment.

Next, in the booster system 1A, if an impeller similar to that in the compression unit 2 is also applied to a rear stage side at higher pressure, many high pressure gas seals and many compressor casings corresponding to high pressure are required. In the respect, the booster system 1A adopts the pump unit 4 on the high pressure side. The pump unit 4 increases pressure of the liquid, and thus can easily seal an object fluid during the pressure increase to a high pressure state (about 15 to 60 [MPa]), thereby avoiding an increase in cost.

Figure 4:
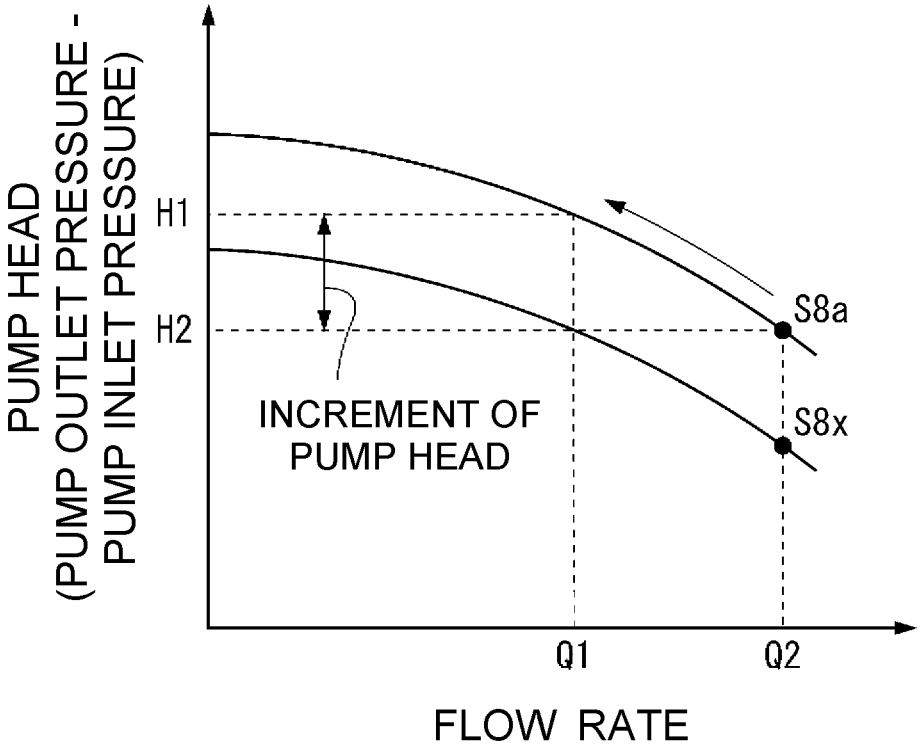
FIG. 4 is a Q-H diagram showing changes in performance property of a pump unit in response to a state of a fluid introduced into the pump unit in connection with the booster system according to the first embodiment.

FIG. 4 is a Q-H diagram showing a relationship of deviation (pump head) between the inlet pressure P1 and the outlet pressure P2 of the pump unit 4 with the flow rate. As show in FIG. 4, a Q-H curve of the intermediate supercritical pressure liquid F2 in the state S8*x* generally has a smaller pump head than a Q-H curve of the intermediate supercritical pressure liquid F2 in the state S8*a*. Specifically, as the temperature of the intermediate supercritical pressure liquid F2 increases and the density thereof decreases, the pressure of the target pressure liquid F3 generated by the pump unit 4 decreases and enters a state S8*y* in FIG. 2.

The target pressure liquid F3 in the state S8*y* is introduced into the heating unit 5, heated under equal pressure, and turns into the target supercritical fluid F4 in a state S9*x*.

As such, adjusting the temperature of the intermediate supercritical pressure liquid F2 introduced into the pump unit 4 can adjust the pressure (target pressure) of the target supercritical fluid F4 finally obtained without changing a pump rotation speed or the like of the pump unit 4.

Further, as shown in FIG. 4, even under a condition at a low flow rate, adjusting the temperature of the intermediate supercritical pressure liquid F2 introduced into the pump unit 4 can adjust the pressure of the target supercritical fluid F4 finally obtained to certain target pressure without changing the pump rotation speed or the like of the pump unit 4.

This allows target pressure to be obtained without providing, for example, a variable speed motor or the like in the pump unit 4.

Further, in this embodiment, the pressure of the target supercritical fluid F4 is detected as needed by the pressure detection unit 8A provided in a middle position of the pipe line L13 and the pipe line L14. The detected pressure values (the inlet pressure P1 and the outlet pressure P2) are input to the control unit 91 of the cooling temperature regulating unit 9A. The control unit 91 decides and regulates the opening degree of the flow regulating unit 92 through a predetermined calculation. The above operation is autonomously performed by the cooling temperature regulating unit 9A and the pressure detection unit 8A. Thus, even if the pressure of the target supercritical fluid F4 changes due to a disturbance factor or the like, the opening degree of the flow regulating unit 92 is autonomously regulated according to the change, and the pressure of the target supercritical fluid F4 is corrected to predetermined desired target pressure. This allows the target supercritical fluid F4 to be supplied at stable pressure.

In this embodiment, the main cooling unit 31 uses the low temperature liquid F5 from the liquid extracting and pressure reducing unit 6 as the cooling medium. However, if an appropriate external cooling medium W can be obtained from outside, precooling by the precooling unit 33 can reduce cold energy required by the main cooling unit 31. For example, in this case, cooling from the state S7*b* to the state S7*c* is performed by the precooling unit 33 and cooling from the state S7*c* to the state S8*a* is performed by the main cooling unit 31.

As means for regulating the flow rate of the introduced gas F0 introduced into the compression unit 2, for example, an IGV (not shown) is adopted. The IGV is a throttle valve that is provided in a middle of a pipe line and can regulate an opening degree. As the opening degree of the IGV decreases, the flow rate of the introduced gas F0 introduced into the compression unit 2 can be reduced. In this embodiment, the IGV is preferably provided at an introducing portion of the first stage compression impeller 11.

Figure 5:
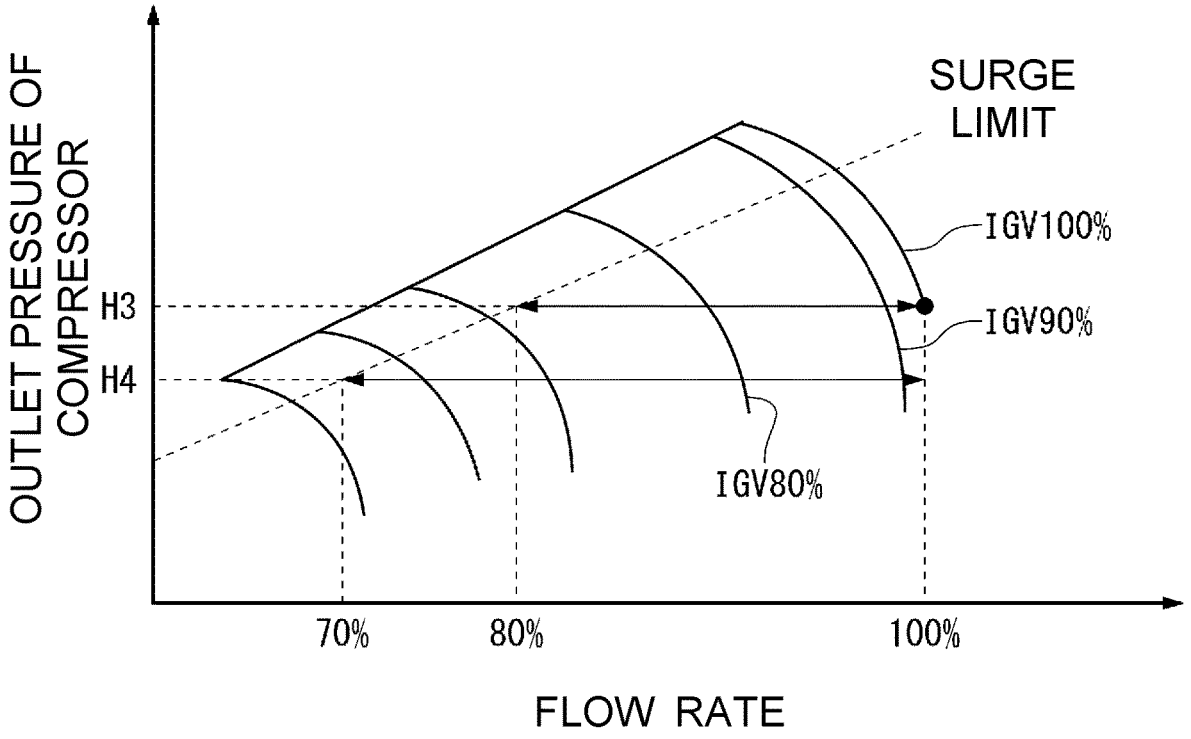
FIG. 5 is a diagram showing an opening degree of IGV of a compression unit and a performance property in response to a flow rate of a fluid introduced into the compression unit in connection with the booster system according to the embodiment.

FIG. 5 is a diagram showing a performance property in response to a change in the IGV opening degree of the compression unit 2. As can be seen from FIG. 5, as the IGV opening degree decreases from 100% as a fully open state to 90%, 80% . . . , the flow rate of the fluid introduced into the compression unit 2 decreases. At higher discharge pressure of the compression unit 2, a value of a limit flow rate at which a surge limit is reached is higher. The example in FIG. 5 shows two operation states of discharge pressure H3 and discharge pressure H4 lower than the discharge pressure H3. For the discharge pressure H3, the surge limit is reached at a flow rate of 80%, while for the discharge pressure H4, the flow rate at which the surge limit is reached is extended to 70%. Thus, the pump head of the pump unit 4 is increased at a low flow rate, thereby allowing an amount of compression required for the compression unit 2 to be reduced. This allows the discharge pressure of the compression unit 2, that is, the pressure of the intermediate supercritical fluid F1 generated by the compression unit 2 to be reduced.

As such, reducing the IGV opening degree to reduce the discharge pressure can extend an allowable flow rate range (operation range).

This can extend a pressure range of the target supercritical fluid F4 obtained by the booster system 1A.

Second Embodiment

Next, with reference to FIGS. 6 to 8, a booster system 1B according to a second embodiment of the present invention will be described.

The booster system 1B has the same basic configuration as the booster system 1A of the first embodiment except that a pressure detection unit 8B detects a different part, and an opening degree of a flow regulating unit 92 of a cooling temperature regulating unit 9B is controlled by a different method. Thus, the differences will be mainly described below.

[Pressure Detection Unit 8B]

Figure 6:
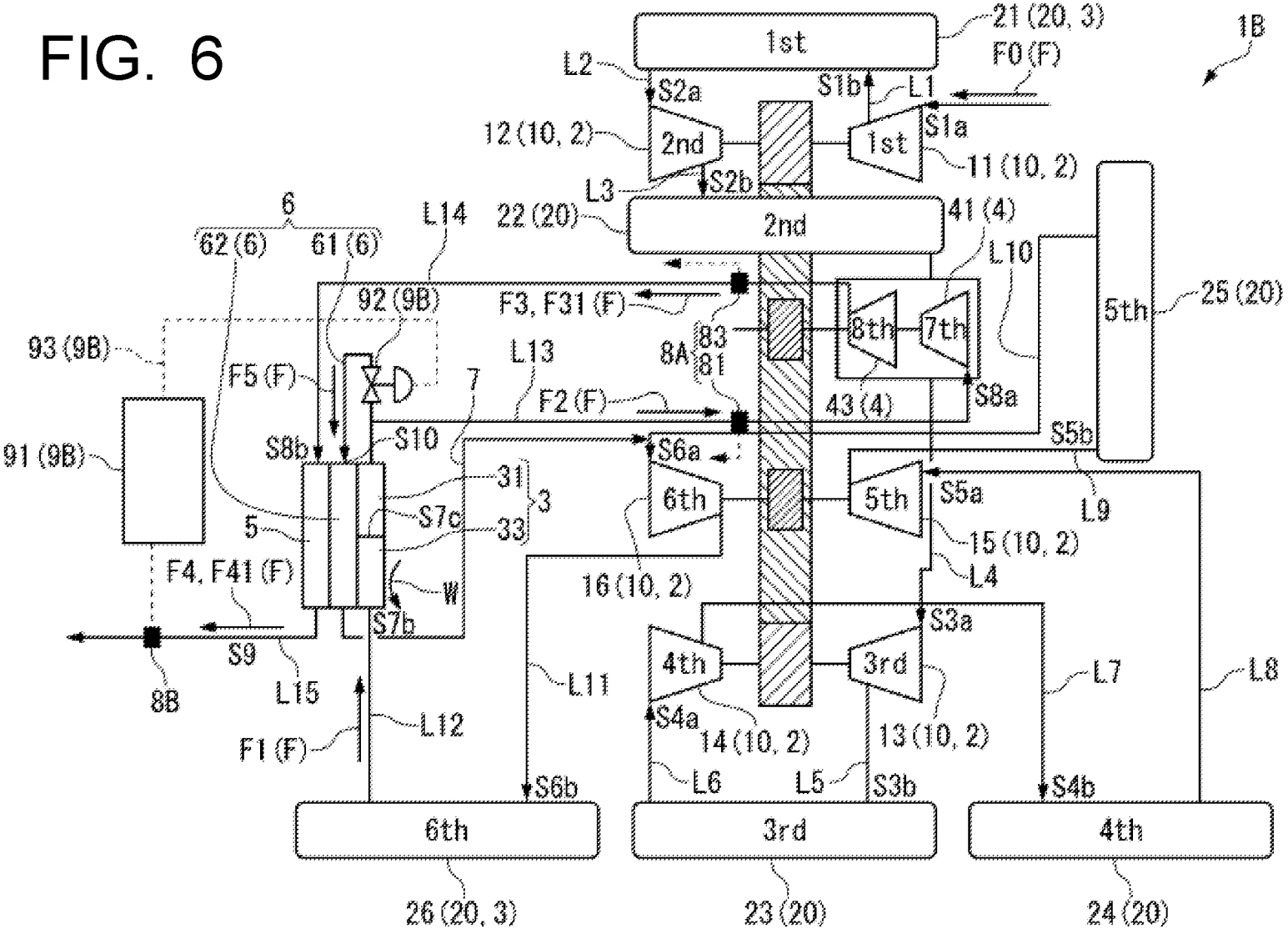
FIG. 6 is a schematic system diagram of a booster system according to a second embodiment of the present invention.
Figure 7:
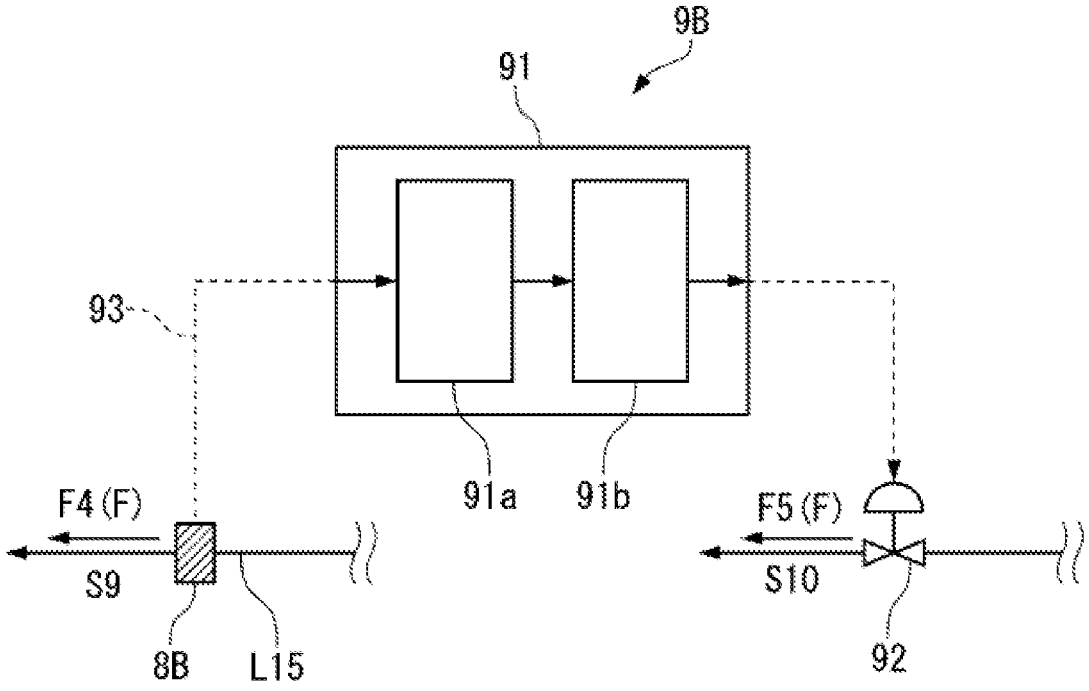
FIG. 7 is an enlarged view of main portions of a configuration of a temperature cooling unit in connection with the booster system according to the second embodiment.

As shown in FIGS. 6 and 7, the booster system 1B includes the pressure detection unit 8B in a middle of a pipe line L15. The pressure detection unit 8B measures outlet pressure P2 as a pressure value of a target supercritical fluid F4 flowing through the pipe line L15.

The outlet pressure P2 measured by the pressure detection unit 8B is transmitted to a control unit 91 of the cooling temperature regulating unit 9B.

[Cooling Temperature Regulating Unit 9B]

The cooling temperature regulating unit 9B includes the control unit 91 and the flow regulating unit 92 like the cooling temperature regulating unit 9A, and the flow regulating unit 92 generates a low temperature liquid F5 in the same manner as in the first embodiment.

As shown in FIG. 7, the control unit 91 includes a determination unit 91*a* and a flow rate decision unit 91*b*, and as described below, what is determined by the determination unit 91*a* is different from that in the first embodiment.

The determination unit 91*a* compares outlet pressure P2 detected by the pressure detection unit 8A with a preset determination value Ps to calculate a deviation $\Delta P = P2 - Ps$. The determination unit 91*a* transfers the deviation $\Delta P$ as a determination result to the flow rate decision unit 91*b*.

Figure 8:
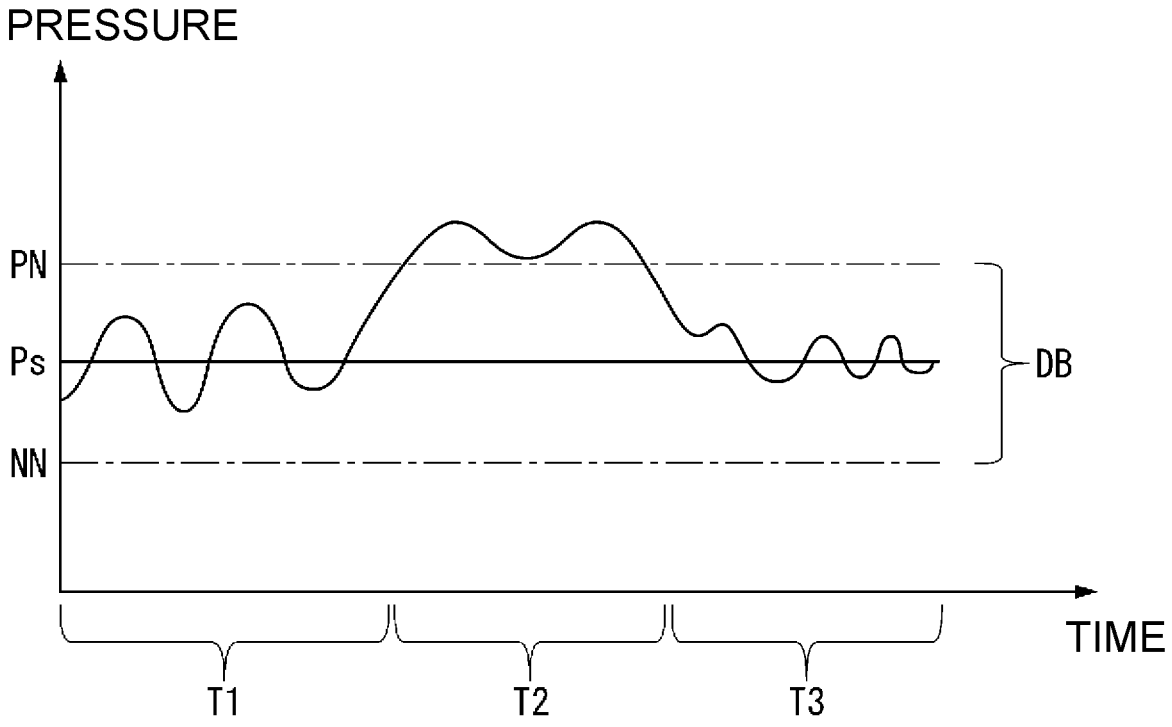
FIG. 8 illustrates a dead band included in a control unit in connection with the booster system according to the second embodiment.

As shown in FIG. 8, the determination unit 91*a* includes a dead band DB for determination, and is adapted to transfer the deviation $\Delta P$ as the determination result to the flow rate decision unit 91*b* if the outlet pressure P2 exceeds a range of the dead band DB, while not to transfer the deviation $\Delta P$ to the flow rate decision unit 91*b* when the outlet pressure P2 falls within the range of the dead band DB. Information on the dead band DB is previously stored in the determination unit 91*a*.

As shown in FIG. 8, the dead band DB is set as a range between a predetermined positive value PN and a predetermined negative value NN with reference to the determination value Ps. The determination unit 91*a* determines whether or not the outlet pressure P2 is the predetermined value PN or less and the predetermined negative value NN or more. For example, in the case in FIG. 8, the determination unit 91*a* does not transfer the deviation ΔP to the flow rate decision unit 91*b* in periods T1 and T3 but transfers the deviation ΔP to the flow rate decision unit 91*b* in a period T2.

The flow rate decision unit 91*b* calculates an opening degree of the flow regulating unit 92 based on the obtained deviation ΔP, and transfers instruction information on an increase/decrease in the opening degree to the flow regulating unit 92 as in the first embodiment. The flow regulating unit 92 (flow regulating valve) having obtained the instruction information from the flow rate decision unit 91*b* regulates the opening degree according to the instruction information.

As described above, discharge pressure control includes the dead band DB, and the flow regulating unit 92 is regulated only when the outlet pressure P2 of a pump unit 4 significantly changes. Thus, when the outlet pressure P2 changes little, the deviation ΔP is regarded as zero, and a previous flow rate is maintained without changing the opening degree of the flow regulating unit 92. When the outlet pressure P2 is significantly deviated from the determination value Ps, the deviation ΔP is no longer zero, and in this case, the opening degree of the flow regulating unit 92 is regulated. This reduces time when the control of the outlet pressure P2 and the control of suction pressure of the pump unit 4 are simultaneously performed, thereby preventing interference between the controls.

Besides the above, the configurations in the embodiment may be chosen or changed to other configurations without departing from the gist of the present invention.

For example, in the above embodiments, the example of the compression unit 2 including the geared compressor has been described, but not limited to the geared compressor, the compression unit 2 may adopt other types of compressors.

REFERENCE SIGNS LIST

1A booster system
1B booster system
2 compression unit
3 cooling unit
4 pump unit
5 heating unit
6 liquid extracting and pressure reducing unit
7 bypass flow path
8A pressure detection unit
8B pressure detection unit
9A cooling temperature regulating unit
9B cooling temperature regulating unit
10 impeller
11 first stage compression impeller
12 second stage compression impeller
13 third stage compression impeller
14 fourth stage compression impeller
15 fifth stage compression impeller
16 sixth stage compression impeller
20 intermediate cooler
21 first intermediate cooler
22 second intermediate cooler
23 third intermediate cooler
24 fourth intermediate cooler
25 fifth intermediate cooler
26 sixth intermediate cooler
31 main cooling unit
33 precooling unit
41 first stage pump impeller
43 second stage pump impeller
61 branch pipe line
62 heat exchanger
81 first pressure sensor
83 second pressure sensor
91 control unit
91*a* determination unit
91*b* flow rate decision unit
92 flow regulating unit
93 control signal wire

The invention claimed is:

1. A booster system for increasing pressure of an object gas to pressure equal to or higher than target pressure that is higher than critical pressure, comprising:

a compression unit configured to compress the object gas to intermediate pressure equal to or higher than the critical pressure and lower than the target pressure to generate an intermediate supercritical fluid;

a cooling unit configured to cool the intermediate supercritical fluid generated by the compression unit to under a critical temperature to generate a liquid at supercritical pressure;

a pump unit configured to increase pressure of the liquid at supercritical pressure generated by the cooling unit to pressure equal to or higher than the target pressure;

a cooling temperature regulating unit configured to regulate a temperature of the liquid at supercritical pressure generated by the cooling unit on upstream of the pump unit according to a flow rate of a supplied cooling medium; and a pressure detection unit configured to detect inlet pressure P1 of the liquid at supercritical pressure on an inlet side of the pump unit and detect outlet pressure P2 of a target supercritical fluid on an outlet side of the pump unit, wherein the cooling temperature regulating unit controls the flow rate of the cooling medium based on a pressure difference between the inlet pressure P1 and the outlet pressure P2 or a pressure ratio between the inlet pressure P1 and the outlet pressure P2.

2. A booster system for increasing pressure of an object gas to pressure equal to or higher than target pressure that is higher than critical pressure, comprising:

a compression unit configured to compress the object gas to intermediate pressure equal to or higher than the critical pressure and lower than the target pressure to generate an intermediate supercritical fluid;

a cooling unit configured to cool the intermediate supercritical fluid generated by the compression unit to under a critical temperature to generate a liquid at supercritical pressure;

a pump unit configured to increase pressure of the liquid at supercritical pressure generated by the cooling unit to pressure equal to or higher than the target pressure;

a cooling temperature regulating unit configured to regulate a temperature of the liquid at supercritical pressure generated by the cooling unit on upstream of the pump unit according to a flow rate of a supplied cooling medium; and a pressure detection unit configured to detect outlet pressure P2 of a target supercritical fluid on an outlet side of the pump unit, wherein the cooling temperature regulating unit increases or decreases the flow rate of the cooling medium based on a deviation ΔP between the outlet pressure P2 and a preset determination value Ps when the outlet pressure P2 exceeds a range of a dead band with reference to the determination value Ps, and the cooling temperature regulating unit maintains a previous flow rate of the cooling medium when the outlet pressure P2 falls within the range of the dead band.

3. The booster system according to claim 1, wherein the pump unit includes one or more pump.

4. The booster system according to claim 1, further comprising:

a heating unit configured to heat the liquid at supercritical pressure increased in pressure by the pump unit to a critical temperature to generate a target supercritical fluid, wherein the cooling unit includes a main cooling unit configured to perform heat exchange with the heating unit to cool the intermediate supercritical fluid increased in pressure by the pump unit.

5. The booster system according to claim 1, wherein the cooling temperature regulating unit extracts a part of the intermediate supercritical fluid generated by the compression unit and uses the part of the intermediate supercritical fluid as the cooling medium.

6. The booster system according to claim 1, wherein the cooling temperature regulating unit regulates the flow rate of the cooling medium supplied into the cooling unit.

7. The booster system according to claim 4, wherein the cooling temperature regulating unit includes a flow regulating unit configured to regulate the flow rate of the cooling medium supplied into the cooling unit, and a control unit configured to control the flow regulating unit based on a detection value detected by the pressure detection unit, and the control unit includes a determination unit configured to determine whether or not the detection value falls within a predetermined pressure range, and a flow rate decision unit configured to decide the flow rate to be regulated by the flow regulating unit based on a determination result of the determination unit.

8. The booster system according to claim 1, wherein the cooling temperature regulating unit controls the flow rate of the cooling medium based on a pressure difference between the inlet pressure P1 and the outlet pressure P2.

9. The booster system according to claim 1, wherein the cooling temperature regulating unit controls the flow rate of the cooling medium based on a pressure ratio between the inlet pressure P1 and the outlet pressure P2.

10. The booster system according to claim 1, wherein the object gas is carbon dioxide.

11. The booster system according to claim 2, wherein the object gas is carbon dioxide.

12. The booster system according to claim 2, wherein the pump unit includes one or more pump.

13. The booster system according to claim 2, further comprising:

a heating unit configured to heat the liquid at supercritical pressure increased in pressure by the pump unit to a critical temperature to generate a target supercritical fluid, wherein the cooling unit includes a main cooling unit configured to perform heat exchange with the heating unit to cool the intermediate supercritical fluid increased in pressure by the pump unit.

14. The booster system according to claim 2, wherein the cooling temperature regulating unit extracts a part of the intermediate supercritical fluid generated by the compression unit and uses the part of the intermediate supercritical fluid as the cooling medium.

15. The booster system according to claim 2, wherein the cooling temperature regulating unit regulates the flow rate of the cooling medium supplied into the cooling unit.

16. The booster system according to claim 13, wherein the cooling temperature regulating unit includes a flow regulating unit configured to regulate the flow rate of the cooling medium supplied into the cooling unit, and a control unit configured to control the flow regulating unit based on a detection value detected by the pressure detection unit, and the control unit includes a determination unit configured to determine whether or not the detection value falls within a predetermined pressure range, and a flow rate decision unit configured to decide the flow rate to be regulated by the flow regulating unit based on a determination result of the determination unit.

17. The booster system according to claim 3, further comprising:

a heating unit configured to heat the liquid at supercritical pressure increased in pressure by the pump unit to a critical temperature to generate a target supercritical fluid, wherein the cooling unit includes a main cooling unit configured to perform heat exchange with the heating unit to cool the intermediate supercritical fluid increased in pressure by the pump unit.

18. The booster system according to claim 3, wherein the cooling temperature regulating unit extracts a part of the intermediate supercritical fluid generated by the compression unit and uses the part of the intermediate supercritical fluid as the cooling medium.

* * * * *